United States Patent [19]

Dean et al.

[11] Patent Number: 5,066,019

[45] Date of Patent: Nov. 19, 1991

[54] THERMALLY-EMISSIVE, WEAPONRY TARGET, TRAINING AID OR ARC DESIGNATOR STRUCTURE

[75] Inventors: William R. Dean, Chandlers Ford; John H. Waters, Farnham, both of England

[73] Assignee: Hitchcox Targets Limited, Hampshire, England

[21] Appl. No.: 543,811

[22] PCT Filed: Feb. 1, 1989

[86] PCT No.: PCT/GB89/00030

§ 371 Date: Jul. 30, 1990

§ 102(e) Date: Jul. 30, 1990

[87] PCT Pub. No.: WO89/07232

PCT Pub. Date: Aug. 10, 1989

[30] Foreign Application Priority Data

Feb. 1, 1988 [GB] United Kingdom ..... 8802140

[51] Int. Cl.[5] ..... F41J 5/08

[52] U.S. Cl. ..... 273/348.1

[58] Field of Search ..... 273/348.1

[56] References Cited

U.S. PATENT DOCUMENTS

| | | | |
|---|---|---|---|
| 4,253,670 | 3/1981 | Moulton et al. | 273/348.1 |
| 4,260,160 | 4/1981 | Ejnell | 273/348.1 |
| 4,279,599 | 7/1981 | Marshall | 273/348.1 |
| 4,346,901 | 8/1982 | Booth | 273/348.1 |
| 4,659,089 | 4/1987 | Rosa | 273/348.1 |
| 4,706,963 | 11/1987 | Geuss | 273/348.1 |
| 4,792,142 | 12/1988 | Davies | 273/348.1 |

*Primary Examiner*—William H. Grieb

*Attorney, Agent, or Firm*—Watts, Hoffmann, Fisher & Heinke Co.

[57] ABSTRACT

A thermally-emissive structure which can be a weaponry target, training aid or arc designator structure, the structure having a high heat emissivity material, such as matt black paint, applied in areas which are to define a thermally-emissive target. The mark-space ratio of the image so produced is varied over the area where the high heat emissivity material is applied to achieve the desired thermal image. The structure is eletrically-heated and includes a heating element in the form of a plastics film having an electrically-conductive metallic coating. The plastics films are joined to a carrier member which in turn is joined to a rigid backing member of a material with good thermal insulating properties. The high heat emissivity material is applied to the plastics film and when the electrically-conductive coating is heated, thermal emission is markedly greater where the high heat emissivity material has been applied. The front of the plastics film is covered with an insulating material which allows transmission of thermal radiation through it.

23 Claims, 4 Drawing Sheets

THERMALLY-EMISSIVE, WEAPONRY TARGET, TRAINING AID OR ARC DESIGNATOR STRUCTURE

Figure 1:
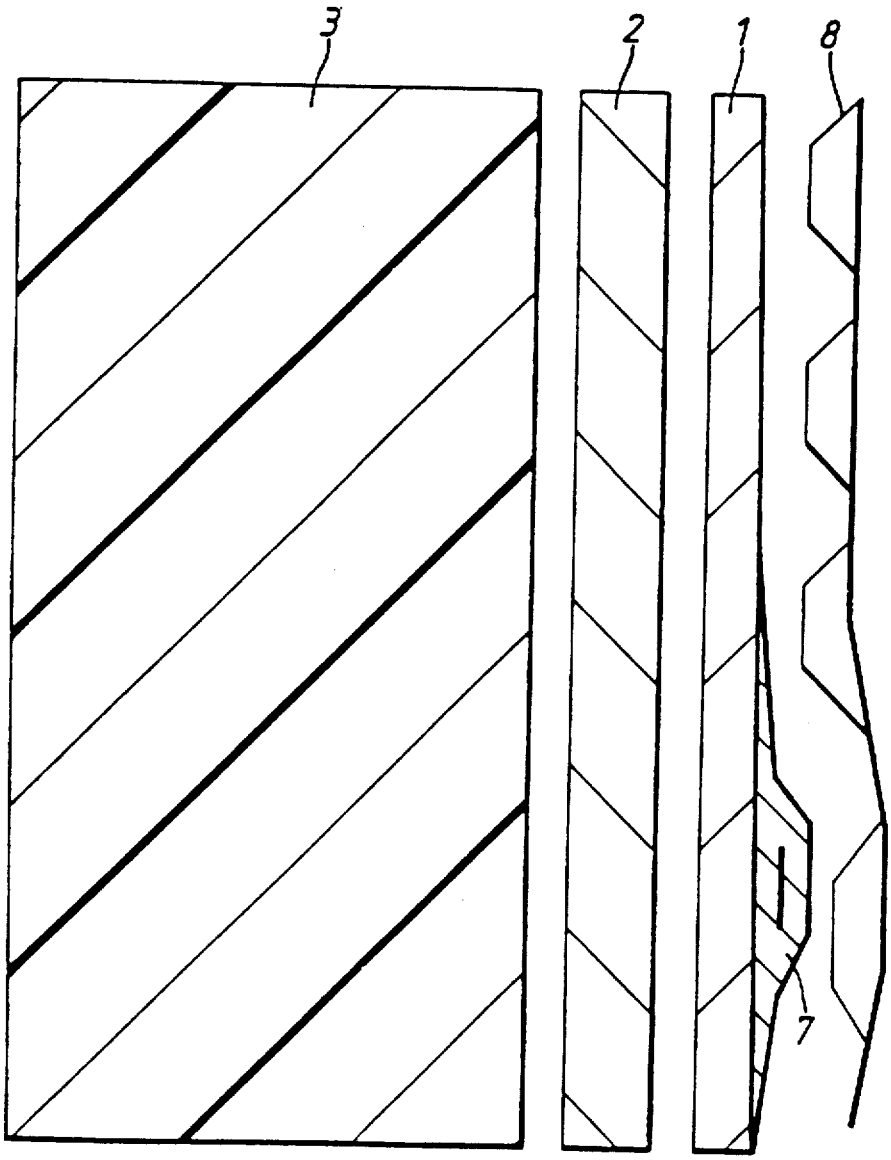

This invention relates to a thermally-emissive, weaponry target, training aid or arc designator structure.

An electrically operated military target is known from WO 83/01105 which includes a plurality of modules mounted adjacent to one another on a support frame. Each module carries an electrically-conductive laminate for emitting infra-red radiation when a current is passed through it. The laminate in fact includes electrically-insulating top and bottom layers, between which an electrically-conductive layer is sandwiched. This electrically-conductive layer includes at least two areas having different effective electrical resistance to emit differing infra-red signals when an electrical current is passed therethrough for infra-red detection.

According to the present invention, there is provided a thermally-emissive structure including a surface, the surface being, in a region or regions intended to define an area to be detected by a thermal imager, darkened relatively to other regions thereof by high heat emissivity material and, in use, being heated above ambient temperature by a heating element in the form of a plastics film having an electrically-conductive matallic coating of substantially uniform electrical resistance, characterised in that said plastics film with its coating is joined to a flexible carrier member itself joined to a rigid backing member, which thereby provides a relatively high thermal mass, and said area is formed by an image defined by darkened regions over said area to achieve the desired thermal image when an electrical current is passed through said coating.

The image may be applied as a matrix of dots, bars or similar patterns. The high heat emissivity material may comprise matt black paint.

The matallic coating can be of aluminium or an aluminium alloy. The aluminium can be vacuum deposited on the plastics film. The plastics film may be a polyester film.

The rigid backing member can be of, for example, foamed plastics material or other material with good thermal insulating properties.

The high heat emissivity material can be applied to the surface of the coating facing away from the plastics film.

The surface of the coating which faces away from the plastics film may be covered by a material having good thermal insulation properties whilst having good transparency in the thermal range to allow transmission of thermal radiation therethrough. Such a material can be a plastics material such as a layer of polyethylene with air bubbles formed in it.

The structure can be in the form of a weaponry target structure and whole structure can be mounted as a panel, with others if required, onto target panels of two-dimensional or three-dimensional targets.

The structure in a smaller version could be used as a classroom training aid.

The structure can also be formed as an arc designator which would give a thermal indication to those in the field of the boundary of a safety area. Presently, arc designators are formed as panels about 20 m high with a letter or numeral painted on them.

Figure 2:
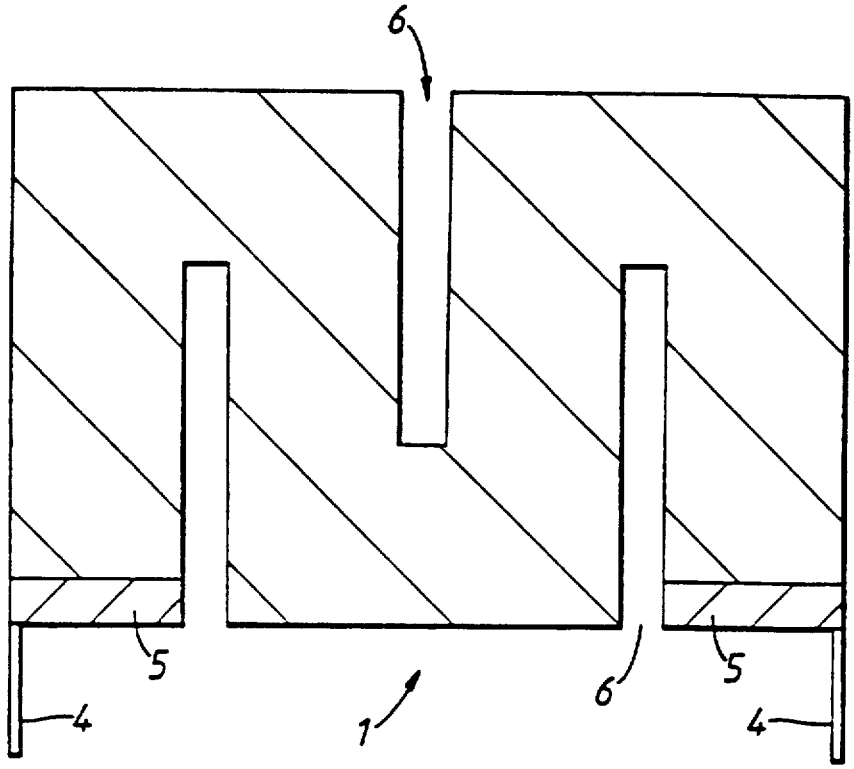
Figure 3:
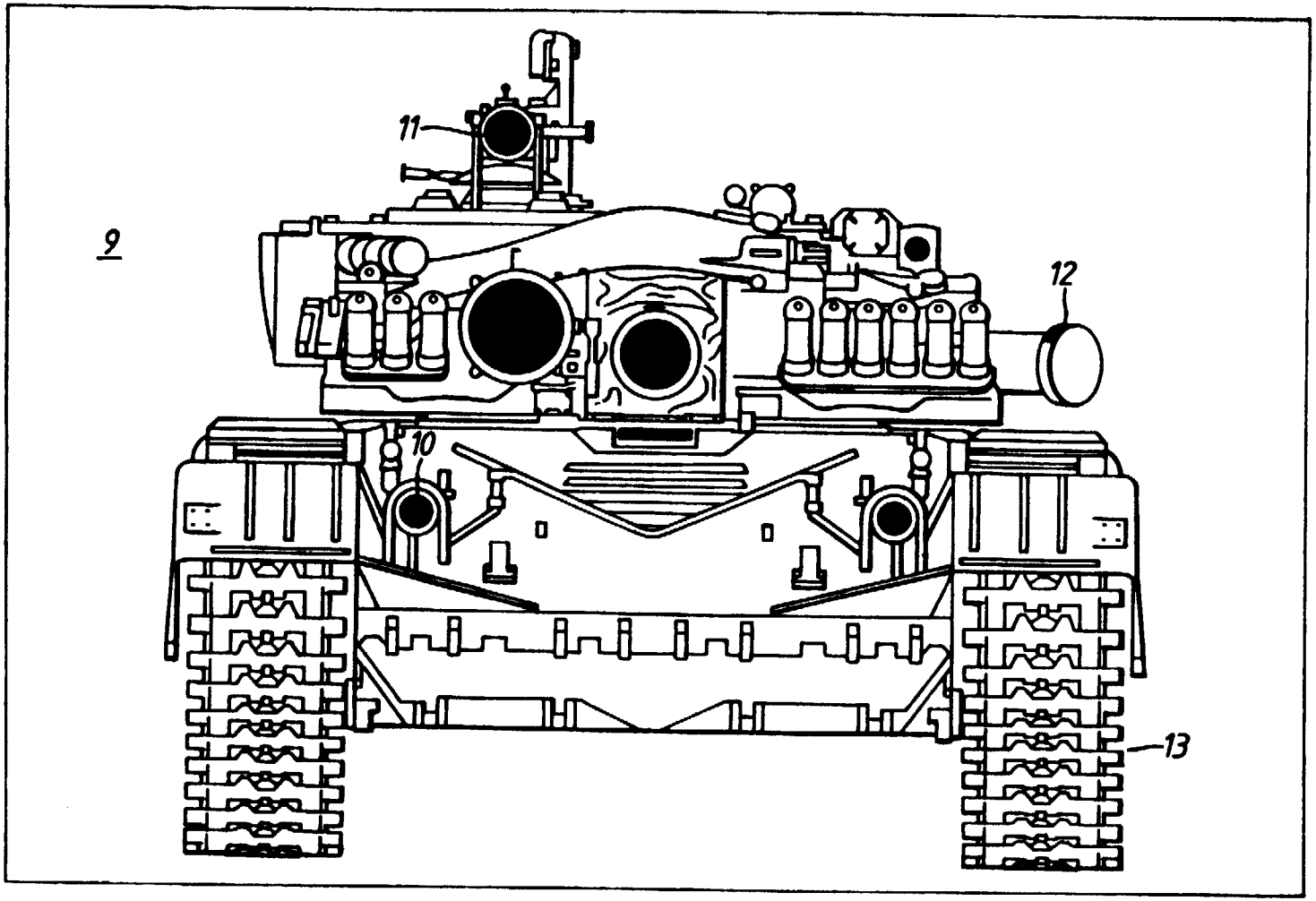
Figure 4:
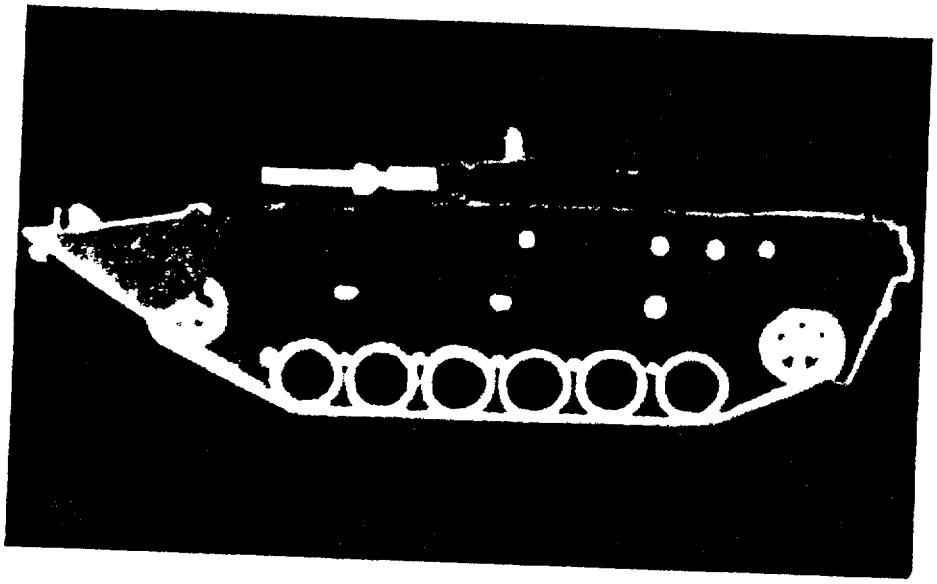
Figure 5:
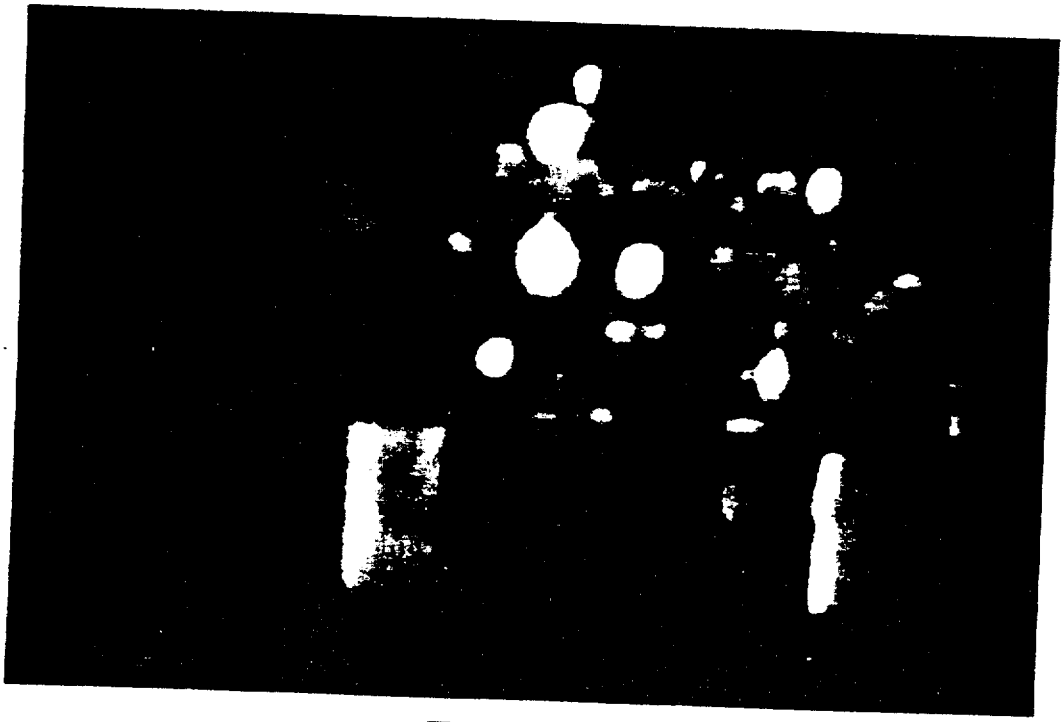

For a better understanding of the invention and to show how it may be carried into effect, reference will now be made, by way of example, to the accompanying drawings, in which:

FIG. 1 is a schematic side view of an electrically-heated, thermally-emissive, structure which can be used as a weaponry target, training aid or arc designator structure, FIG. 2 is a schematic front view of a heating element shown in FIG. 1, FIG. 3 is a diagrammatic front view of a thermally-emissive structure which can be used as a weaponry target, training aid or arc designator structure, FIG. 4 is a photographic reproduction of a thermal image as detected by a thermal imager which was directed onto a structure according to the present invention, and FIG. 5 is another photographic reproduction of a thermal image detected.

The structure described hereinafter is a weaponry target structure and is arranged to provide a thermal emissivity which is varied to provide a thermal image of a target capable of being detected on a thermal imager and any weapon system that the imager is used to aim. The structure could also be formed as a training aid or an arc designator.

The structures illustrated in the drawings include a heating element 1 in the form of a plastics film having an electrically-conductive metallic coating, preferably of aluminium, deposited thereon. The plastics film is joined to a carrier member 2 which can be of a flexible, non-absorbent material, which in turn is joined to a rigid backing member 3 of foamed plastics material or other material with good thermal insulating properties. The electrically-conductive metallic coating can be located between the plastics film and the carrier member 2 in order to inhibit degradation of the metallic coating.

Electrodes 4, preferably copper wire electrodes, are attached by means of electrically-conductive contact pads 5 along electrically opposite edges of the coated plastics film of the heating element 1 and are led away via insulated leads to terminals of an electrical power source (not shown) which may be electronically regulated to vary the overall temperature. The shape, aspect ratio and electrical path length may be varied to suit the particular intended application of the structure and, as shown in FIG. 2, slots 6 can be provided in the coating to increase the electrical path length. However, the electrical resistance over the path length is substantially uniform.

In the embodiment illustrated, it is the outer surface of the coating facing away from the plastics film which is given an image of a target such as a tank and this can be done by applying a high emissivity matt black paint 7. The black paint is applied as a matrix of dots, bars or similar patterns and the effective relative temperature or strength of heat emissivity is controlled by varying the mark/space ratio of the dots, bars or similar patterns to allow representative thermal images of target vehicles etc. to be created. The electrically conductive metallic coating is of comparatively low heat emissivity.

FIG. 3 depicts a typical target panel 9 showing an image of the front of a tank. In practice, the image could be applied to a plurality of adjacent panels.

Certain areas of a real tank are known to be thermally-emissive, i.e. are above ambient temperature and these areas have been identified as locations such as head lights 10, various ports 11, the tip of an exhaust outlet 12 and even the endless tracks 13. These and other areas so identified in practice as being thermally-emissive, are darkened with high heat-emissivity material and the mark/space ratio of the image is varied as appropriate to give the intended intensity of thermal emission.

FIGS. 4 and 5 are photographic reproductions of what has been achieved in practice using a structure according to the invention. FIG. 4 is the result of a thermal image of the side view of a tank depicted on the present structure and FIG. 5 is a front view of the tank. In both views, the thermally-emissive areas are clearly depicted by the lightened regions of the image detected. The view illustrated in FIG. 5 corresponds to that of FIG. 3.

In order to reduce power consumption, the structure so far described is insulated from contact with the surrounding air by means of a layer 8 of thermally-insulating material which however has the property of allowing transmission through it of thermal radiation. Such a material can be polyethylene or a similar material with air bubbles in it. In fact, the layer 8 of insulating material should be transparent in the infrared wavebands. It should be borne in mind that thermal imagers will be sensitive even with differences of only 1 or 2° C. above ambient temperature.

The plastics film of the heating element 1 can be a polyester film and the various components can be joined to one another by adhesive such as a contact adhesive. If desired, the layer 8 of insulating material may surrond the whole assembly so that it is effectively encased in a plastics bag only broken at locations where the electrical supply leads for the heating element pass through.

In operation, althrough the whole of the electrically conductive coating is heated, thermal emission is markedly greater where the matrix of dots is applied and since thermal imagers tend to look at areas rather than the dots or bars etc., then the imagers will not be affected by the "white" spaces between the dots or bars. However, in regions where there are no dots or bars, the thermal imagers will only detect or "see" the ambient temperature.

It is envisaged that the invention could be extended to the case where an electronically-controlled image can be produced in place of the image provided by matt black paint so that the medium from which the image is transmitted becomes the high heat emissivity material.

It will be appreciated that the present structure will be particularly advantageous for use in remote areas where there is no readily available power supply because of the comparatively low power requirement of the structure.

The present structure can also be utilised to assist in positive, real vehicle identification. For example, the structure could be applied to an ambulance and a thermal imager could pick up the image of a red cross or red crescent on the structure, thereby indicated that it is not a target for attack.

We claim:

1. A thermally-emissive structure comprising a surface, the surface being, in a region or regions intended to define an area to be detected by a thermal imager, darkened relatively to other regions thereof by high heat emissivity material; heating means for heating said high heat emissivity material above ambient temperature by a heating element in the form of a plastic film having an electrically-conductive metallic coating of substantially uniform electrical resistance; a flexible carrier member and a rigid backing member, said plastic film with its coating being joined to said flexible carrier member which is itself joined to said rigid backing member, said structure providing a relatively high thermal mass wherein said area is formed by an image defined by darkened regions over said area to achieve the desired thermal image when an electrical current is passed through said coating.

2. A structure according to claim 1, wherein the image is applied as a matrix of dots, bars or similar patterns.

3. A structure according to claim 1, wherein said image is formed by varying the mark/space ratio over said area to achieve the desired thermal image.

4. A structure according to claim 1, wherein said high heat emissivity material comprises matt black paint.

5. A structure according to claim 1, wherein one surface of said film and/or said coating is darkened relatively to other regions thereof by high heat emissivity material as aforesaid.

6. A structure according to claim 5, wherein said metallic coating is of aluminum or aluminum alloy.

7. A structure according to claim 1, wherein said plastics film is a polyester film.

8. A structure according to claim 1, wherein said carrier member is formed of a flexible, non-absorbent backing material.

9. A structure according to cliam 1, wherein said rigid backing member is formed of foamed plastic material.

10. A structure according to claim 1, wherein said high heat emissivity material is applied to the surface of said coating which faces away from said plastic film.

11. A structure according to claim 1, wherein the surface of the coating which faces away from said plastic film is covered by a material having good thermal insulation properties whilst having good transparency in the thermal range to allow transmission of thermal radiation therethrough.

12. A structure according to claim 11, wherein said material on the surface of the coating which faces away from the plastic film is comprised by a layer of polyethylene with air bubbles formed in it.

13. A structure according to claim 1, further comprising electrically-conductive contact pads and electrodes connected to said electrically-conductive metallic coating for connection of said coating to an electrical power source.

14. A structure according to claim 1, wherein slots are provided in said metallic coating to increase the electrical path length.

15. A structure according to claim 1, further comprising a layer of insulating material surrounding substantially the whole of the structure.

16. A structure according to claim 1, wherein said image is produced by electronically-controlled means so that the medium from which the image is transmitted becomes the high heat emissivity material.

17. A structure according to claim 1 and being in the form of a weaponry target structure.

18. A structure according to claim 1, wherein said weaponry target structure is mounted as a panel on a two-dimensional or three-dimensional target.

19. A structure according to claim 1 and being in the form of a classroom training aid.

20. A structure according to claim 1 and being in the form of an arc designator.

21. A structure according to claim 1 wherein the rigid backing member is a motorized vehicle.

22. A structure according to claim 21 wherein said structure further comprises a rigid backing member and said flexible carrier member is itself joined to said rigid backing member.

23. A thermally-emissive structure comprising:

(a) a surface, the surface being, in a region or regions intended to define an area to be detected by a thermal imager, darkened relatively to other regions thereof by high heat emissivity material;

(b) heating means for heating said high heat emissivity material above ambient temperature by a heating element in the form of a plastic film having an electrically-conductive metallic coating of substantially uniform electrical resistance; and, (c) a flexible carrier member, said plastic film with its coating being joined to said flexible carrier member, said structure providing a relatively high thermal mass wherein said area is formed by an image defined by darkened regions over said area to achieve the desired thermal image when an electrical current is passed through said coating.

* * * * *